US005409024A

United States Patent [19]

Morrison

[11] Patent Number: 5,409,024

[45] Date of Patent: Apr. 25, 1995

[54] APPARATUS FOR CLEANING AIR BRUSHES

[75] Inventor: Adam P. Morrison, Rockford, Ill.

[73] Assignee: Testor Corporation, The, Rockford, Ill.

[21] Appl. No.: 147,126

[22] Filed: Nov. 3, 1993

[51] Int. Cl.[6] ..... B08B 13/00

[52] U.S. Cl. ..... 134/104.2; 55/332; 55/465; 239/112; 239/121

[58] Field of Search ..... 134/104.2, 104.4; 55/320, 327, 332, 465; 239/112, 113, 120, 121; 15/353

[56] References Cited

U.S. PATENT DOCUMENTS

| | | | |
|---|---|---|---|
| 2,672,950 | 3/1954 | Leiman | 55/332 X |
| 3,339,350 | 9/1967 | Sims . | |
| 3,932,151 | 1/1976 | Lau . | |
| 3,957,469 | 5/1976 | Nebash | 55/320 X |
| 4,507,132 | 3/1985 | Yoshida | 55/320 X |
| 4,561,868 | 12/1985 | von Reis et al. . | |
| 4,606,776 | 8/1986 | Salis . | |
| 4,673,423 | 6/1987 | Yumlu . | |
| 4,934,393 | 6/1990 | Lighthall et al. . | |
| 5,039,323 | 8/1991 | Ulitsky et al. . | |

FOREIGN PATENT DOCUMENTS

| | | | |
|---|---|---|---|
| 1172798 | 6/1964 | Germany | 55/320 |
| 3661 | of 1912 | United Kingdom | 55/332 |
| 1329801 | 8/1987 | U.S.S.R. | 55/320 |

*Primary Examiner*—Philip R. Coe

*Attorney, Agent, or Firm*—Fay, Sharpe, Beall, Fagan, Minnich & McKee

[57] ABSTRACT

A method and apparatus useful for collecting the liquid solvents and paint expelled from an air brush while the air brush is being cleaned. The method and apparatus include direct impact of the expelled fluid against a baffle wall followed by direction reversal and expansion of the flowing fluid to collect the liquid portion in a chamber while discharging the gas and any solid particles entrained therein through a filter element.

9 Claims, 2 Drawing Sheets

APPARATUS FOR CLEANING AIR BRUSHES

BACKGROUND OF THE INVENTION

The subject invention relates generally to the art of air brushes or paint spray devices and, more particularly, to an apparatus for collecting paint and solvents that are discharged when cleaning such devices.

As is well known, air brushes use a compressed gas, such as air, to atomize and dispense liquids including inks, paints, and lacquers through a spray nozzle or tip. The flow of the spray is regulated by a manually operated needle valve. At the termination of a spraying operation, or when changing the liquid being dispensed, the air brush must be cleaned by flushing a suitable solvent through the brush supply tubes, needle valve, and spray nozzle. The solvent used for cleaning depends, of course, upon the particular type of paint or the fluid which was previously being sprayed. In any event, the solvent with entrained paint, pigments, and fluids exits from the spray nozzle and should preferably be captured for disposal rather than being dispensed into the ambient atmosphere.

In the past, absorbent rags, filters, and the like have sometimes been used for collecting the solvent discharge. Alternatively, various types of collection devices have been used with limited success. See, for example, the devices shown in U.S. Pat. Nos. 4,606,776 and 4,934,393. In U.S. Pat. No. 4,606,776, the disclosed device uses vertically extending, horizontally spaced filters to trap or absorb the solvent discharge. The device shown in U.S. Pat. No. 4,934,393, on the other hand, uses a relatively complex arrangement of filters, negative pressure chambers, and condensers to collect the solvent.

SUMMARY OF THE INVENTION

The subject invention has for a primary object the provision of a simplified method and apparatus that is easy to use and which allows the cleaning solvent and paint pigments and fluids exiting from the air brush during a cleaning operation to be efficiently and effectively collected.

In accordance with one aspect of the invention, there is provided an apparatus for receiving and collecting the materials discharging from an air brush during cleaning of the air brush with a solvent fluid. The apparatus generally comprises a housing which defines a main chamber having an outlet with a filter member extending thereover. An inlet tube with a discharge opening opens within the housing includes a receiving opening exterior of the housing for receiving the discharge of paint and cleaning fluid from an air brush being cleaned to conduct the fluid into the housing. Walls in the housing define a narrow first chamber with a baffle wall located in closely spaced relationship to the discharge opening such that paint and cleaning fluid coming through the inlet tube impacts against the baffle wall and is directed radially relative to the discharge opening. A connecting opening from the first chamber to the main chamber acts to direct fluid from the first chamber into the main chamber in a direction opposite the direction of the outlet so that flow from the first chamber through the main chamber to the outlet undergoes a total reversal in direction.

Preferably, the housing is defined by a container having a closed bottom wall, closed side wall means, and an open upper end which forms the outlet. The filter element is preferably releasably joined to the container to extend over the open top and is retained in position by a retaining ring releasably connected to the container.

In accordance with a further aspect of the invention, the first chamber is defined by an insert element which is received in the open upper end of the container and retained in position by the retainer ring. The narrow first chamber is defined by a pair of closely spaced wall carried in the insert member.

In use, solvent is flushed through the air brush using the normal compressed gas source causing the fluid solvent fluid to pass through the air brush. The air brush discharge spray nozzle or tip is applied to the inlet tube and the combined solvent fluid, propellant gas and entrained paint or solid materials are discharged through the inlet tube into the narrow first chamber against the baffle wall. A portion of the paint laden solvent is, of course, caused to undergo both expansion and a change in direction to reach the radially located connecting openings from the second chamber to the first chamber. In the main chamber, the fluid and gas mixture must undergo further expansion and a second direction reversal causing the liquid portion of the mixture to be retained in this main chamber. Any paint solids or the like which are contained in the exiting propellant gas are trapped in the filter which extends across the outlet.

In accordance with yet another aspect of the invention, the first chamber is preferably located between the main chamber and the outlet and the gas and any uncollected liquids and solids which are directed upwardly from the main chamber pass radially outward of both the first chamber and the Jets of fluid which connect the first chamber with the main chamber.

As can be seen from the foregoing, a primary object of the invention is the provision of an apparatus and method which allows the liquids and solids exiting from an air brush during a cleaning operation to be collected in a manner which prevents their discharge into the ambient atmosphere.

Yet another object is the provision of an apparatus of the general type described which can be made relatively simple and compact. A further object is the provision of an apparatus of the type described which is simple to use and prevents solvents, liquids, and paint solids from being dispersed into the surrounding environment during a cleaning operation.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
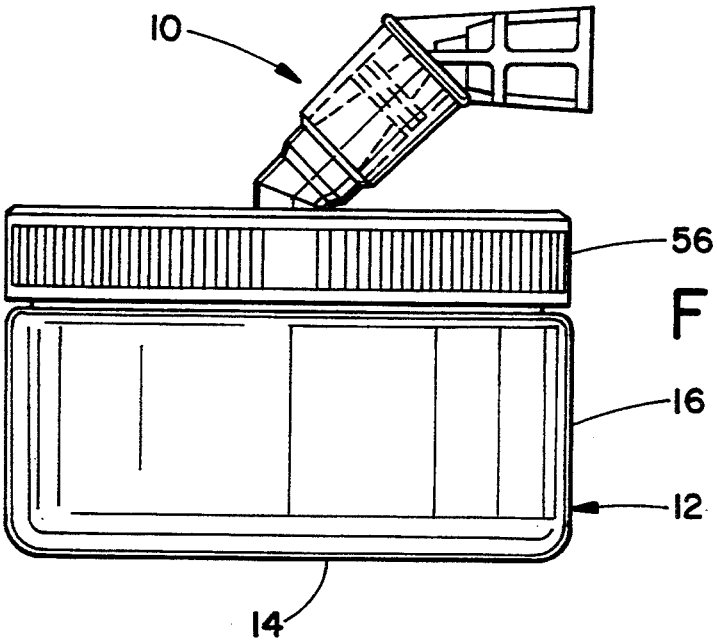
FIG. 1 is a side elevational view of an air brush cleaning receptacle formed in accordance with the preferred embodiment of the invention.
Figure 2:
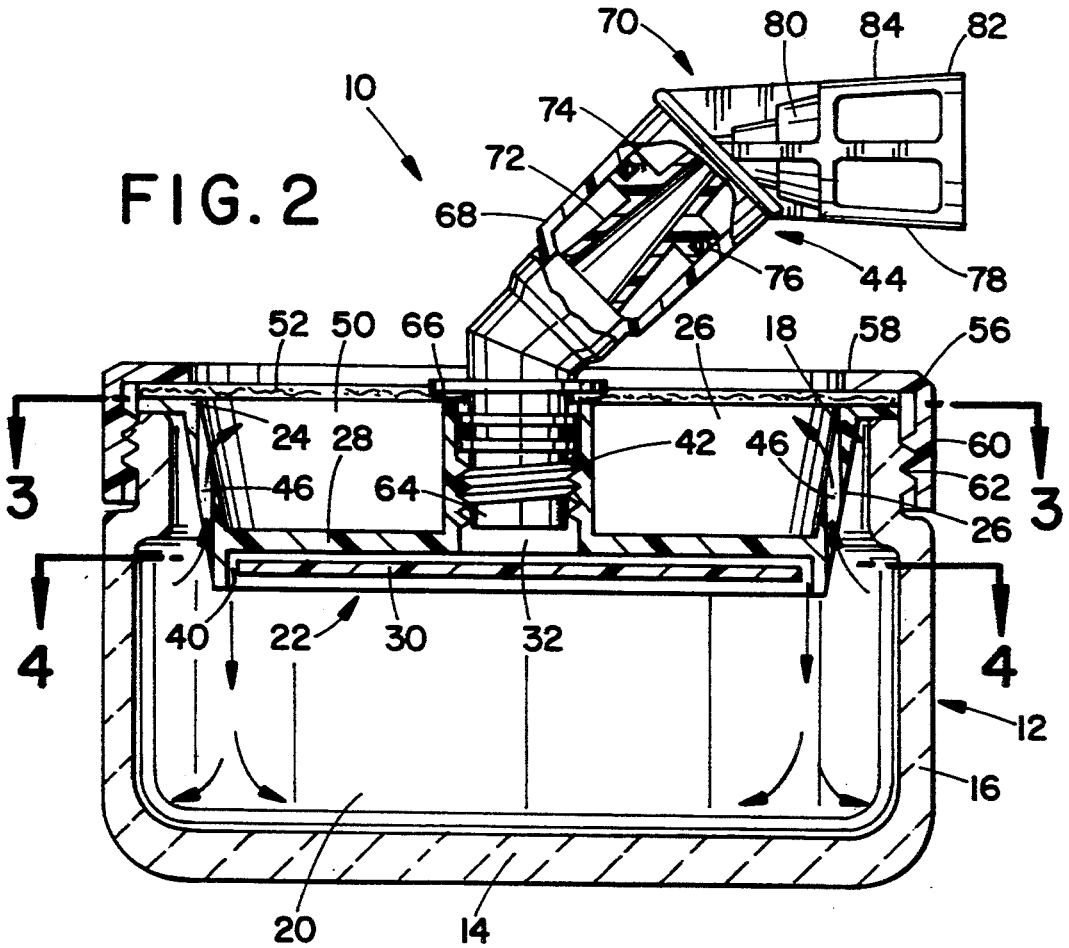
FIG. 2 is a vertical cross-sectional view through the FIG. 1 device; and, FIGS. 3 and 4 are cross-sectional views taken on lines 3—3 and 4—4 of FIG. 2.

Referring more particularly to the drawings wherein the showings are for the purpose of illustrating a preferred embodiment of the invention only, and not for the purpose of limiting same, FIGS. 1 and 2 show the overall arrangement of a receptacle-type apparatus particularly intended for receiving and collecting the materials, such as solvent liquids, paint particles, and pigments which exit from an air brush during cleaning of the air brush with a cleaning solvent. The apparatus shown in FIGS. 1 and 2 is identified with the numeral 10 and generally comprises a container 12 of generally circular cross-section having a closed lower wall 14 and an upwardly extending, peripheral side wall 16. In this embodiment, the container 16 is formed from clear glass and has an open upper end 18.

The container 12 defines a relatively large volume, main chamber 20 which, as will be subsequently understood, acts as an expansion and holding chamber for the cleaning fluids and entrained paint and pigment solids.

Figure 4:
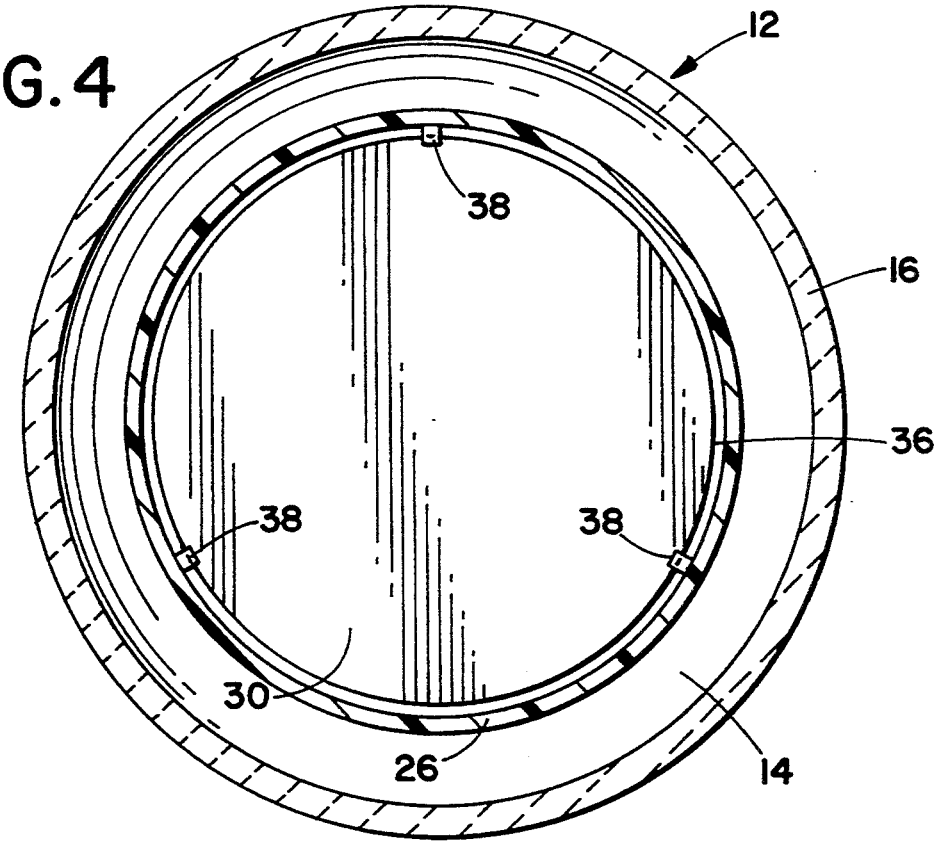

Carried at the upper end of the container 16 and releasably clamped thereto is an insert member 22. The insert member 22 is preferably molded from a relatively rigid plastic and comprises a peripheral, laterally extending annular flange portion 24 which is sized so as to rest on the upper edge of the container side wall 16. A tapered, conically-shaped side wall 26 is formed to extend integrally downward from the peripheral flange portion 24. The wall 26 supports a pair of spaced horizontally extending walls 28 and 30 which together define a first, circular and vertically narrow chamber 32. The wall member 28 extends horizontally and is connected upwardly a short distance from the bottom of the conical side wall 26. The wall 30 is supported as best shown in FIG. 4. Note that it has a circular configuration with its outer peripheral edge 36 spaced closely from the inner surface of the lower end of the wall 26. The wall 30 is supported by three integral tabs 38 which extend inwardly from the wall 26. This arrangement results in a circular narrow opening 40 which opens from chamber 32 downwardly into the outer circumferential portion of the expansion chamber 20.

Figure 3:
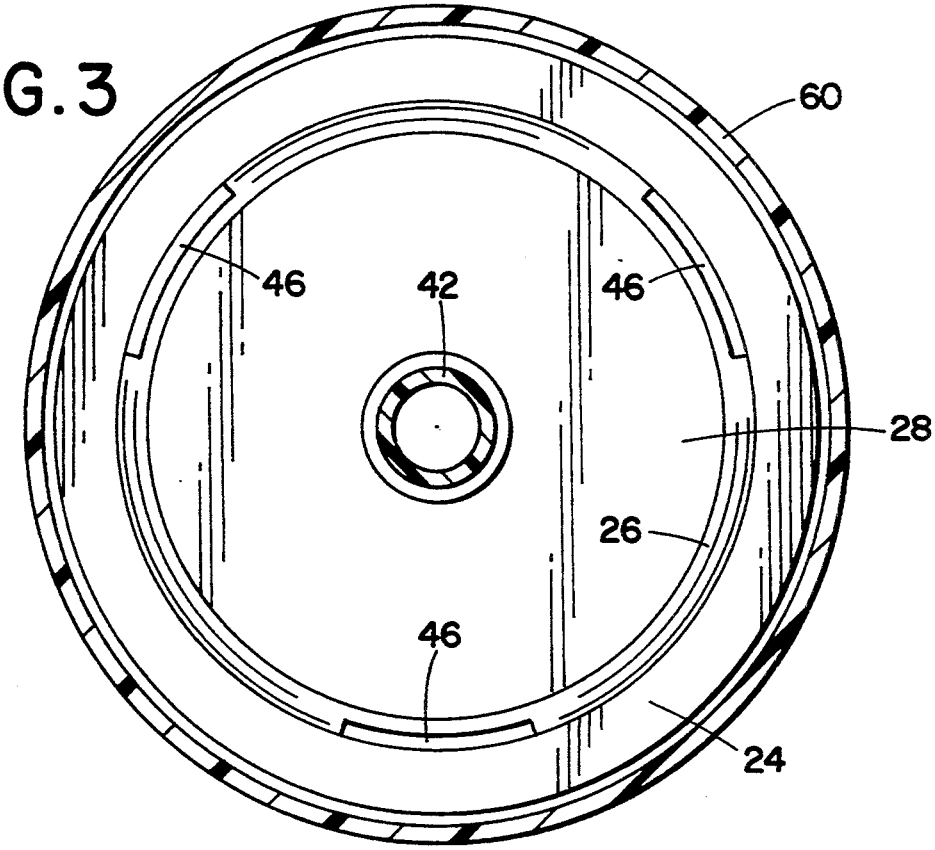

As best shown in FIGS. 2 and 3, a tube section 42 is formed centrally of the wall 28 and extends upwardly therefrom as seen in FIG. 2. The tube 42 functions as an inlet tube and is connected externally of the container 16 to a supply and brush receiving assembly 44 which will subsequently be described in some detail. For the present, however, it should be noted that the insert member 22 further includes a plurality of narrow, upwardly directed slots 46 which, as best seen in FIG. 3, open at circumferentially spaced points through the wall 26. The area above the wall 28 and centrally within the wall 26 defines an upwardly open discharge chamber 50.

The open upper end of the container 16 and the discharge chamber 50 is closed by a transversely extending, circular filter element 52. For reasons which will subsequently be described in conjunction with the description of operation of the subject device, the filter 52 is formed from a fiber mat type material. The openings in the filter are such that the gas used to propel the cleaning solvent and paint particles into the assembly can exit freely therethrough while any dried paint solids which may be carried with the exiting gas are trapped in the fiber filter.

The insert 22 and the fiber filter 52 are firmly but releasably clamped in position on the upper end of the container 12 by a retaining ring element 56. The retaining ring element 56 is molded of plastic and has a horizontally extending flange portion 58 and a downwardly extending threaded retaining portion 60. The retaining portion 60 is releasably threaded to the suitable threads 62 formed about the upper end of the side wall 16 of container Referring again to the inlet tube 42 which extends upwardly from wall 28, it will be seen that the assembly 44 is releasably connected therein by a downwardly extending tubular section 64 which is threaded into the interior of tube 42. It should, of course, be understood that the filter 42 is provided with a suitable central opening to allow free passage of the tubular section 64. Additionally, a radially extending flange 66 is carried on the upper end of tube section 64 to clamp the inner periphery of the filter 52 to the end of the tube 42.

An elbow section 68 is integrally joined to the tube section 64 and extends at an angle thereto. A upper elbow section 70 joins to the lower elbow section 68 with a simple slip fitting arrangement including a generally tapered, lower end section 72 and a circumferential flange section 74 including an O-ring 76 positioned so as to sealingly engage interiorly of the elbow section 68 as best seen in FIG. 2. The outer end portion 78 of the upper elbow 70 is provided with a tapered inlet section SO which joins with the expansion section 72.

A support ring element 82 is supported at the outer end of the section 80 by a plurality of legs 84. Rings 82 and the support legs 84 are sized and positioned so as to allow them to receive and support the tip or spray end of an air brush during a cleaning operation which will subsequently be described. That is, they are arranged so that the air brush nozzle or spray end can be inserted into the section 70 while the cleaning fluid is flushed through the brush through the use of the normal propellant fluid associated with the brush.

In operation, the air brush spray or nozzle end is, as previously mentioned, inserted into the elbow section 70 as previously described. The spray nozzle end is thus in position in the tapered inlet section 80 and is in flow connection with the interior of the lower elbow section 68. The fluid discharged from the spray tip of the air brush thus passes downwardly through the tube 42 and discharges against the center of the lower baffle wall 30 and thereafter travels radially outward to the connecting slot 40 which discharges it directly downwardly into the main chamber 20. The fluid undergoes expansion and reversal in direction in the main chamber 20. The liquid component, together with the entrained solids, are captured and retained in the main chamber 20, and the gas component exits through openings 46 to the discharge chamber. Because of the expansion and reversal in direction which the fluid has been subjected to, only gas and some entrained and relatively dry paint solids enter the discharge chamber 50. The solids are trapped, however, by filter 52 as the gas exits therethrough.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. Apparatus for receiving and collecting the materials discharging from an air brush during cleaning of the air brush with a cleaning fluid comprising:

a) housing means including a container defining a main chamber and comprising a closed bottom wall, closed side wall means and an open top defining an outlet with a filter member releasably joined to the container and extending across the outlet;

b) an inlet tube extending through the open top having a discharge opening within the housing means and a receiving opening exterior of the housing means for receiving the discharge of paint and cleaning fluid from an air brush being cleaned to conduct the fluid into the housing means;

c) a pair of closely spaced walls extending transversely of the main chamber adjacent the top and defining a narrow first chamber with one of said walls forming a baffle wall located in closely spaced relationship to said discharge opening such that paint and cleaning fluid coming through the inlet tube impacts against the baffle wall and is directed radially relative to the discharge opening; and, d) a connecting opening from the narrow first chamber to the main chamber to direct fluid from the first chamber into the main chamber in a direction away from the outlet and toward the bottom wall.

2. The apparatus as defined in claim 1 wherein the pair of closely spaced walls are generally parallel to the bottom wall of the container.

3. The apparatus as defined in claim 1 wherein the walls defining the first chamber are spaced a short distance inwardly from the open top of the container and extend laterally having peripheral edges closely spaced to the closed side wall means.

4. The apparatus as defined in claim 3 wherein the pair of closely spaced walls are supported from the open top of the container.

5. The apparatus as defined in claim 4 wherein the connecting opening is comprised of a series of openings located about the peripheral edges of the pair of closely spaced walls defining the first chamber.

6. The apparatus as defined in claim 1 wherein there is a discharge chamber located above the first chamber and connected in fluid flow relationship with the main chamber by openings located radially outwardly of the connecting opening from the first chamber to the main chamber.

7. The apparatus as defined in claim 6 wherein the discharge chamber has a side wall of truncated conical configuration and the openings connecting the discharge chamber with the main chamber are spaced about the side wall.

8. The apparatus as defined in claim 7 wherein the inlet tube is located axially of the side wall of the discharge chamber.

9. The apparatus as defined in claim 7 wherein the walls defining the first chamber include an uppermost wall which forms a bottom wall of the discharge chamber.

* * * * *